United States Patent [19]

Otsuka et al.

[11] Patent Number: 4,689,979

[45] Date of Patent: Sep. 1, 1987

[54] PRESSING METHOD AND PUNCH AND DIE PRESS FOR THE SAME

[75] Inventors: Nobuyuki Otsuka; Atsuo Kasuya; Yusho Nakayama; Masayuki Kumashiro; Tamio Furuya; Shigeo Kaiho, all of Saitama, Japan

[73] Assignee: Honda Giken Kogyo Kabushiki Kaisha, Tokyo, Japan

[21] Appl. No.: 684,018

[22] Filed: Dec. 20, 1984

[30] Foreign Application Priority Data

Dec. 21, 1983 [JP] Japan ..... 58-241644

[51] Int. Cl.[4] ..... B21D 22/10

[52] U.S. Cl. ..... 72/57; 72/465

[58] Field of Search ..... 72/57, 465, 347

[56] References Cited

U.S. PATENT DOCUMENTS

| | | | |
|---|---|---|---|
| 1,012,401 | 12/1911 | McCullough | 72/57 |
| 3,066,556 | 12/1962 | Jaskowiak | 72/57 |
| 3,208,255 | 9/1965 | Burk | 72/57 |
| 3,264,854 | 8/1966 | Carlisle | 72/63 |
| 3,418,836 | 12/1968 | Olson | 72/57 |
| 3,533,256 | 10/1970 | Hurek | 72/63 |
| 3,635,061 | 1/1972 | Rydell | 72/63 |
| 3,962,895 | 6/1976 | Rydell | 72/63 |
| 4,314,468 | 2/1982 | Basil | 72/57 |
| 4,392,368 | 7/1983 | Folkessa | 72/63 |

FOREIGN PATENT DOCUMENTS

| | | | |
|---|---|---|---|
| 2261955 | 6/1974 | Fed. Rep. of Germany | 72/57 |

*Primary Examiner*—Lowell A. Larson

*Attorney, Agent, or Firm*—Irving M. Weiner; Joseph P. Carrier; Pamela S. Burt

[57] ABSTRACT

A method of pressing a blank comprises the steps of pressing the blank between a die assembly having a cavity with a highly viscous substance contained therein and a punch, inserting the punch into the cavity to increase a pressure of the highly viscous substance in the cavity, and pressing the blank against a surface of the punch under the pressure of the highly viscous substance. The pressing method can form pressed product of complex shape highly accurately and free from cracks, wrinkles, or other damages. There is also disclosed a punch and die press suitable for effecting the abovesaid pressing method.

14 Claims, 22 Drawing Figures

PRESSING METHOD AND PUNCH AND DIE PRESS FOR THE SAME

BACKGROUND OF THE INVENTION

1. Field of the Invention

The present invention relates to a method of pressing a blank such as a metal sheet between die and punch assemblies, and a punch and die press for carrying out such a method.

2. Description of the Prior Art

Metal sheets are generally formed into desired shapes by a means for pressing such metal sheets between a pair of press dies or punch and die assemblies. The dies employed in such a pressing method are required to be highly accurate dimensionally. Where a metal sheet to be pressed has irregular thicknesses, it tends to be cracked, wrinkled, or otherwise damaged even if it is pressed by dies of accurate dimensions.

There is known a method of pressing a blank into a complex shape with dies under the pressure of a liquid filled in the dies, as disclosed in Japanese Patent Publication No. 36-20010. With such a liquid-pressure pressing process, however, it is difficult to control the liquid pressure and it is troublesome to perform the pressing operation due to concern about possible liquid leakage.

Japanese Patent Publication No. 57-55493 discloses a process employing a resilient body such as of rubber in place of a liquid, the process being known as the Guerin process. However, since the resilient body such as of rubber fails to follow the shape of a punch highly accurately, the pressed product is liable to become cracked, wrinkled, or otherwise damaged especially when the product has a complicated configuration.

SUMMARY OF THE INVENTION

With the conventional problems in view, it is an object of the present invention to provide a pressing method capable of highly accurately forming products of complex shape free from cracks, wrinkles, or other damages.

Another object of the present invention is to provide a punch and die press for carrying out the above pressing method.

According to the present invention, a pressing process comprises the steps of pressing a blank between a die assembly having a cavity containing a highly viscous substance and a punch, inserting the punch into the cavity to increase a pressure of the highly viscous substance in the cavity, and pressing the blank against a surface of the punch under the pressure of the highly viscous substance.

The above and other objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
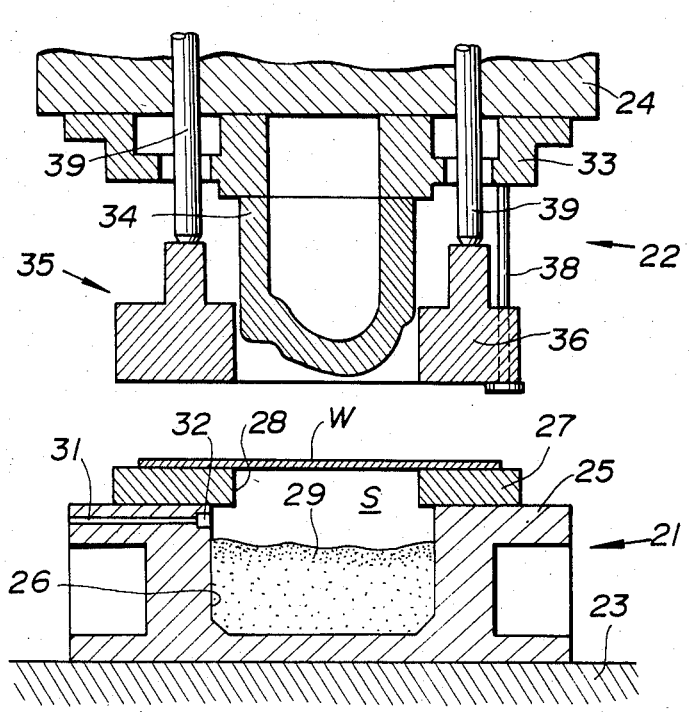
FIG. 1 is a sectional side elevational view of a punch and die press employed for carrying out a pressing method according to a first embodiment of the present invention, the punch and die press being shown in a position prior to the beginning of a pressing process.
Figure 2:
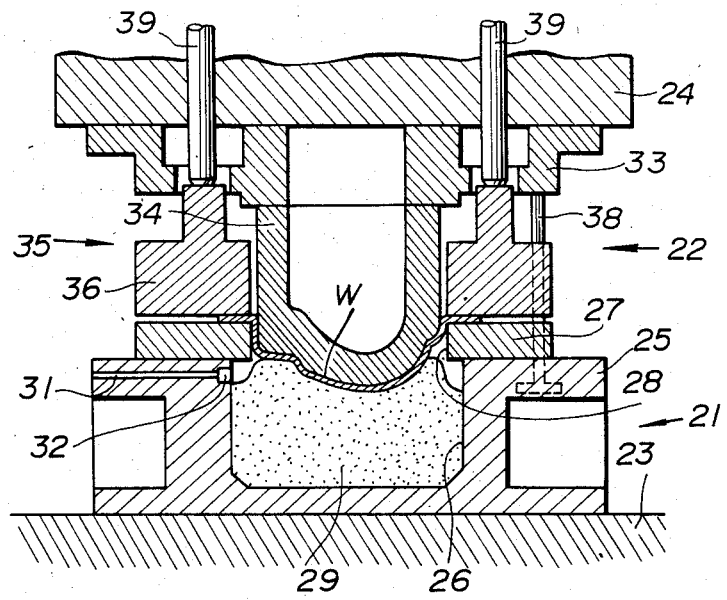
FIG. 2 is a sectional side elevational view of the punch and die press shown in FIG. 1, showing the punch and die press operating in the pressing process.
Figure 3:
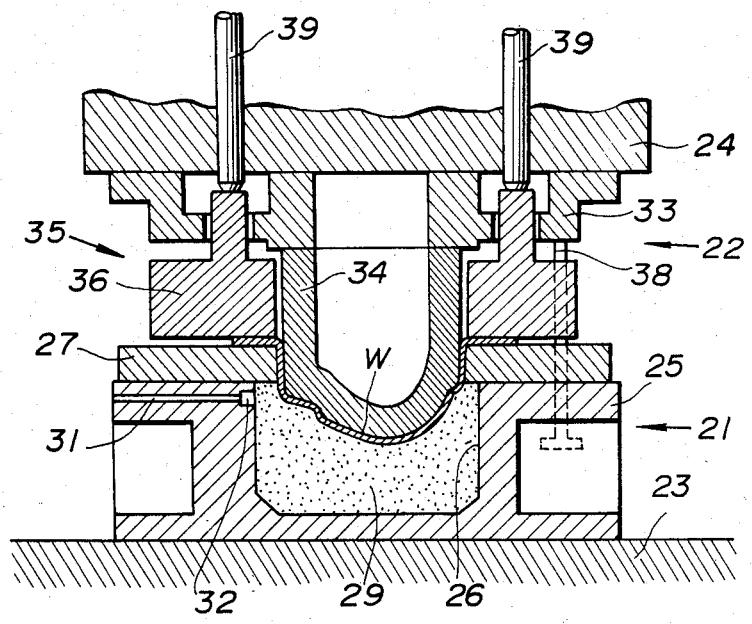
FIG. 3 is a sectional side elevational view of the punch and die press shown in FIG. 1, the view showing the punch and die press at the end of the pressing process.

FIGS. 1 through 3 show in cross section dies or a punch and die press for effecting a pressing method according to a first embodiment of the present invention. The punch and die press generally comprises a die assembly 21 and a punch assembly 22. The punch and die press is used in combination with a known press machine having a bolster plate 23 and a vertically movable ram 24 disposed upwardly of the bolster plate 23. The die assembly 21 is fixedly mounted on the bolster plate 23, while the punch assembly 22 is secured to the ram 24.

The die assembly 21 comprises a die holder 25 having an upwardly opening cavity 26, and a die 27 fixed to an upper surface of the die holder 25 and having a central through hole 28. The cavity 26 is filled with a highly viscous substance 29 having dilatancy and thixotropy, properties such as silicone or a non-curing vinyl chloride sealant. The cavity 26 has an upper opening greater than the central through hole 28 in the die 27 for allowing a punch (described later) to be moved into the cavity 26. The die holder 25 has a passage 31 defined in a side wall thereof for providing communication between the cavity 26 and an exterior side of the die holder 25. An air bleeder valve is disposed in the passage 31 at its end opening into the cavity 26.

The punch assembly 22 comprises a punch holder 33 fixed to the ram 24, a punch 34 secured to the punch holder 33 and coacting with the central through hole 28 in the die 27, and a blank holder mechanism 35 surrounding the punch 34 for deep drawing. The punch 34 has a shape complementary to the configuration of a product to be formed by the punch and die press. The blank holder mechanism 35 comprises a holder member 36 for pressing and holding a blank or metal sheet W between itself and the upper surface of the die 27 under an appropriate pressing force, a plurality of guide rods 38 (only one shown) extending vertically for guiding the holder member 36, and a plurality of blank holder rods 39 for pressing the holder member 36 downwardly toward the die 27. The blank holder rods 39 are actuated by a blank holder ram (not shown) disposed in the press machine.

In operation, when the ram 24 is lowered from the position of FIG. 1, the metal sheet W is held at its peripheral edge between the holder member 36 and the die 27. When the ram 24 is further depressed, the punch 34 enters the cavity 26 while drawing the metal sheet W between the punch 34 and the die 27. The highly viscous substance 29 changes its shape in complementary relation to the lower end of the punch 34, during which time the metal sheet W is pressed between the punch 34 and the highly viscous substance 29 into a shape complementary to the punch 34 under the back pressure of the highly viscous substance 29, as shown in FIG. 2.

Before the metal sheet W is thus formed, as shown in FIG. 1, there is a space S between the highly viscous substance 29 and the metal sheet W. As the punch 34 moves into the cavity 26, air in the space s is discharged out through the air bleeder valve 32 and the passage 31. Finally, air is completely or substantially completely discharged as shown in FIG. 3, and the pressing operation is finished when the pressure in the cavity 26 reaches a prescribed value.

Thereafter, the ram 24 is lifted, and the pressed product is ejected, whereupon the highly viscous substance 29 is released of an external force and returns to its original condition with its surface flattend due to its flowability, readying itself for a next cycle of pressing operation.

Figure 4:
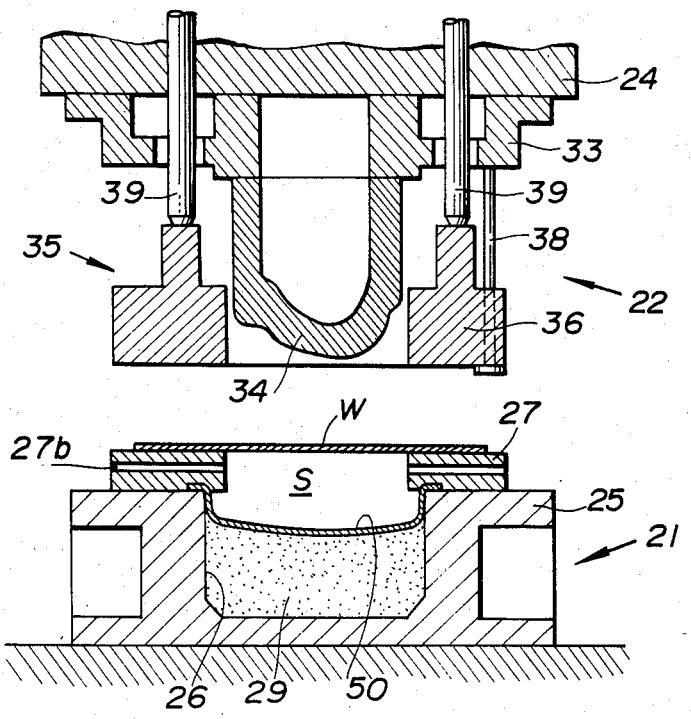
FIG. 4 is a sectional side elevational view of a punch and die press employed for carrying out a pressing method according to a second embodiment of the present invention, the punch and die press being shown in a position prior to the beginning of a pressing process.
Figure 5:
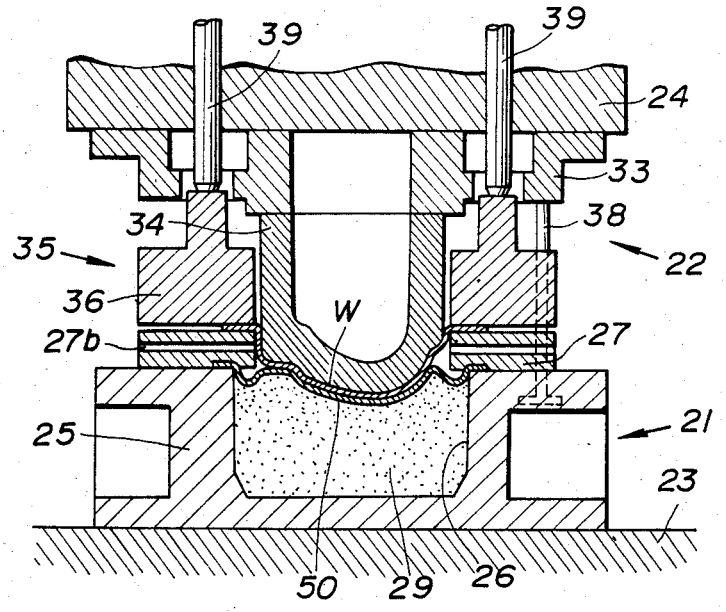
FIG. 5 is a sectional side elevational view of the punch and die press shown in FIG. 4, showing the punch and die press operating in the pressing process.
Figure 6:
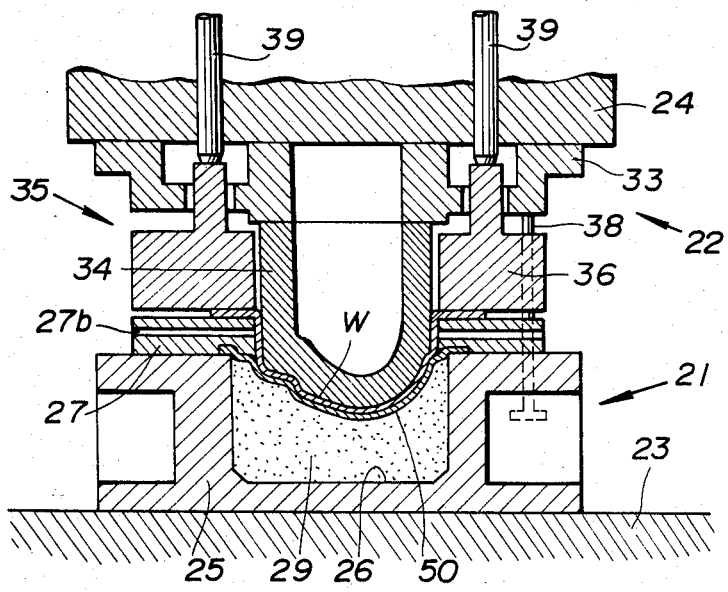
FIG. 6 is a sectional side elevational view of the punch and die press shown in FIG. 4, showing the punch and die press at the end of the pressing process.

FIGS. 4 through 6 illustrate in cross section a punch and die press for carrying out a pressing method according to a second embodiment of the present invention. Identical or corresponding parts shown in FIGS. 4 through 6 are denoted by identical or corresponding reference characters in FIGS. 1 through 3. The punch and die press of the second embodiment differs from that of the first embodiment in that the surface of the highly viscous substance 29 in the cavity is covered with a flexible sheet 50 such as a polyurethane sheet, and a die 27 has a plurality of passages 27*b* defined therein for discharging air from the space S rather than through the passage 31 and the air bleeder valve 32 in the first embodiment. The other structure is the same as that of the punch and die press of the first embodiment.

The pressing method effected by the punch and die press shown in FIGS. 4 through 6 is as follows: A blank or metal sheet W is placed on the die 27, as shown in FIG. 4. When the punch 34 is lowered, the lower end thereof enters the cavity 26 as illustrated in FIG. 5 to change the shape of the highly viscous substance 29. As shown in FIG. 6, the metal sheet W is pressed into a form complementary in shape to the lower end of the punch through the sheet 50 under the back pressure of the highly viscous substance 29. Since the metal sheet W is not brought into direct contact with the highly viscous substance 29 in the pressing method of the second embodiment, no fragments of the highly viscous substance 29 will be attached to the metal sheet W during pressing operation, and the highly viscous substance 29 will not be carried out of the cavity 26 when the pressed product is ejected from the die assembly 21.

Figure 7:
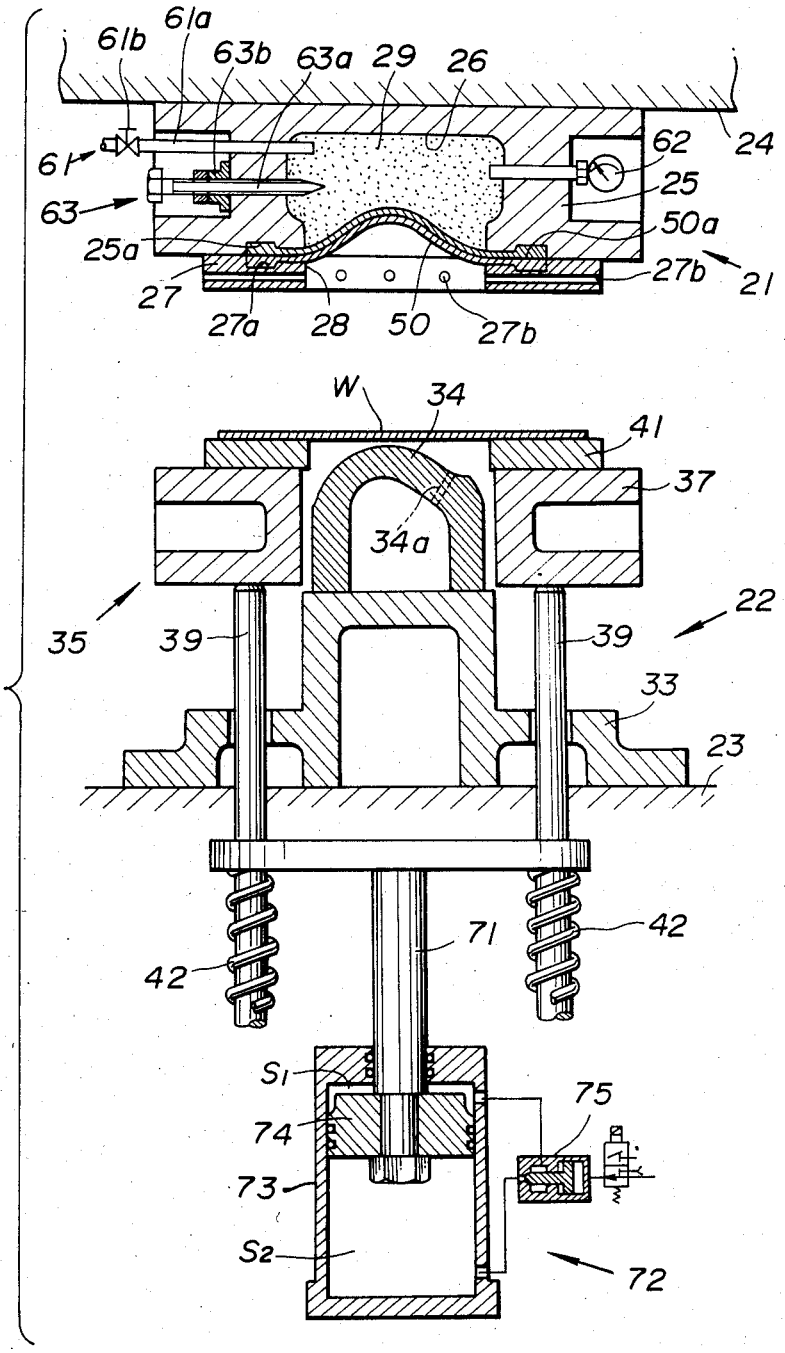
FIG. 7 is a sectional side elevational view of a punch and die press employed for carrying out pressing methods according to third and fourth embodiments of the present invention, the punch and die press being shown in a position prior to the beginning of a pressing process.
Figure 8:
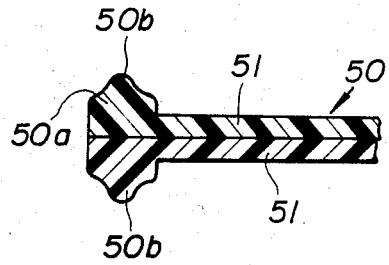
FIG. 8 is an enlarged cross-sectional view of a marginal edge of a pressure sheet in the punch and die press of FIG. 7.
Figure 9:
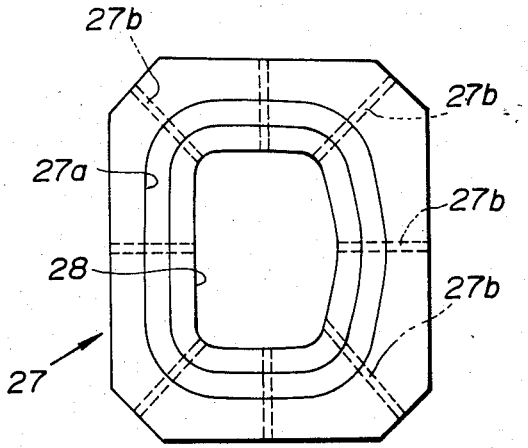
FIG. 9 is a plan view of a die of a die assembly in the punch and die press of FIG. 7.
Figure 10:
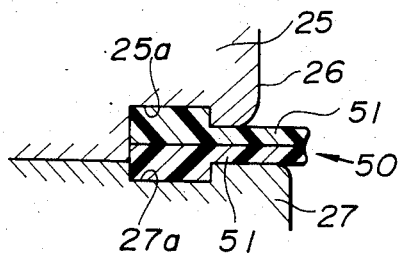
FIG. 10 is a fragmentary cross-sectional view of the die assembly in the punch and die press of FIG. 7, illustrating the die, the pressure sheet, and a die holder which are coupled together.

FIGS. 7 through 9 show in cross section a punch and die press for carrying out a pressing method according to a third embodiment of the present invention. Identical or corresponding parts shown in FIGS. 7 through 9 are denoted by identical or corresponding reference characters in FIGS. 1 through 3.

As illustrated in FIG. 7, the punch and die press comprises a die assembly 21 and a punch assembly 22 which are placed in a known press machine having a bolster plate 23 and a vertically movable ram 24 disposed above the bolster plate 23. The die assembly 21 comprises a die holder 25 having a downwardly opening cavity 26 accommodating a highly viscous substance 29 such as silicone, a die 27 fixed to a lower surface of the die holder 25 and having a central through hole 28, and a flexible pressure sheet 50 clamped between the die holder 25 and the die 27 and closing the opening of the cavity 26 in the die holder 25.

As shown in FIG. 8, the pressure sheet 50 includes two superimposed urethane sheet members 51, 51 which are each 5 mm thick and has a thickened peripheral edge 50*a* having upper and lower ridges 50*b*, 50*b*.

As illustrated in FIG. 9, the die 27 is in the form of a plate having a groove 27*a* defined in an upper surface thereof and extending around the central through hole 28. The die holder 25 also has a groove 25*a* defined in the lower surface thereof in surrounding relation to the opening of the cavity 26 and confronting the recess 27*a* in the die 27.

For attaching the pressure sheet 50 between the die 27 and the die holder 25, the thick peripheral edge 50*a* is fitted in the grooves 25*a*, 27*a*, and the die 27 is fixed to the die holder 25 by bolts. The ridges 50*b*, 50*b* on the peripheral edge 50*a* of the pressure sheet 50 are deformed under pressure and clamped in position within the grooves 25*a*, 27*a* in the die holder 25 and the die 27. With the pressure sheet 50 thus securely mounted, the highly viscous substance 29 in the cavity 26 will not leak during pressing operation, and the pressure sheet 50 will not be detached when forced into the cavity 26.

As shown in FIGS. 7 and 9, the die 27 has a plurality of radial air bleeder holes 27*b* defined therein and having ends opening at a wall surface defining the central through hole 28 and opposite ends opening at an outer peripheral wall surface. Operation of the air bleeder holes 27*b* will be described hereinbelow.

The die holder 25 supports a discharge device 61 for discharging air and the highly viscous substance 29 from the cavity 26, a pressure gage 62 for indicating the pressure of the highly viscous substance 29 in the cavity 26, and an adjusting device 63 for adjusting the pressure of the highly viscous substance 29. The discharge device 61 comprises a discharge pipe 61*a* having one end extending into the cavity 26 and an opposite end positioned out of the cavity 26 for discharging air and the highly viscous substance 29, and a valve 61*b* disposed in the discharge pipe 61*a*. The adjusting device 63 comprises a rod 63*a* slidably and hermetically fitted in a hole extending through a side wall of the cavity 26 and having an externally threaded portion, and a nut 63*b* threaded over the externally threaded portion of the rod 63*a* and secured to the die holder 25. By turning the rod 63*a*, it is axially moved into or out of the cavity 26 to reduce or increase the volume of the cavity 26 for thereby effecting fine adjustment of the maximum pressure which the highly viscous substance 29 sealed in the cavity 26 should have during pressing operation.

For filling the highly viscous substance 29 in the cavity 26, the die holder 25 is placed with the opening of the cavity 26 being directed upwardly. The highly viscous substance 29 has a so-called dilatancy property such that its flowability is lost when subjected to an abrupt external force and is restored if the applied external force is reduced. The highly viscous substance may be silicone or a non-curing vinyl chloride sealant. The amount of the highly viscous substance sealed in the cavity according to the third embodiment is different from that of the fourth embodiment as described hereinbelow. After the highly viscous substance 29 has been sealed, the pressure sheet 50 and the die 27 are placed in a prescribed position on the die holder 25 to cover the surface of the highly viscous substance 29 with the pressure sheet 50, and the die 27, the pressure sheet 29, and the die holder 25 are coupled together by the bolts, thus assembling the die assembly 21. The completed die assembly 21 is turned upside down and attached to the ram 24 (FIG. 7).

The punch assembly 22 comprises a punch holder 23 for being fixed to the bolster plate 33, a punch 34 fixed to the punch holder 33 for coacting with the central through hole 28 in the die 27, and a blank holder mechanism 35 disposed around the punch 34 and having a construction suitable for deep drawing of a blank. The punch 34 is hollow and has an upper half surface shaped complementarily to a desired product configuration. The punch 34 has a recess disposed in the vicinity of its top end and a through passage 34*a* communicating between the recess and the hollow interior of the punch 34. Operation of the through passage 34*a* will be described hereinbelow.

The blank holder mechanism 35 includes a blank holder base 37 disposed vertically movably around the punch 34, a holder plate 41 mounted on an upper surface of the blank holder base 37 for holding the blank W between the die assembly 21 and the die 27, and a plurality of blank holder rods 39 supporting the blank holder base 37 for vertically moving the same. The blank holder rods 39 are normally urged by springs 42 toward an upper limit of their vertical movement, and are controlled in their vertical movement by a blank holder ram 71 on the press machine. The blank holder ram 71 is driven by a cylinder unit 72 (schematically shown in FIG. 7) comprising a cylinder 73 having upper and lower chambers $S_1$, $S_2$ divided by a piston 64 and an on-off valve 75 for selectively bringing the upper and lower chambers $S_1$, $S_2$ into and out of communication with each other.

The pressing method according to the third embodiment, using the punch and die press shown in FIG. 7, will be described below.

In this method, pressing operation is preceded by an adjustment for making the final pressing pressure of the highly viscous substance 29 equal to a desired value at the time of completion of the pressing operation.

Figure 11:
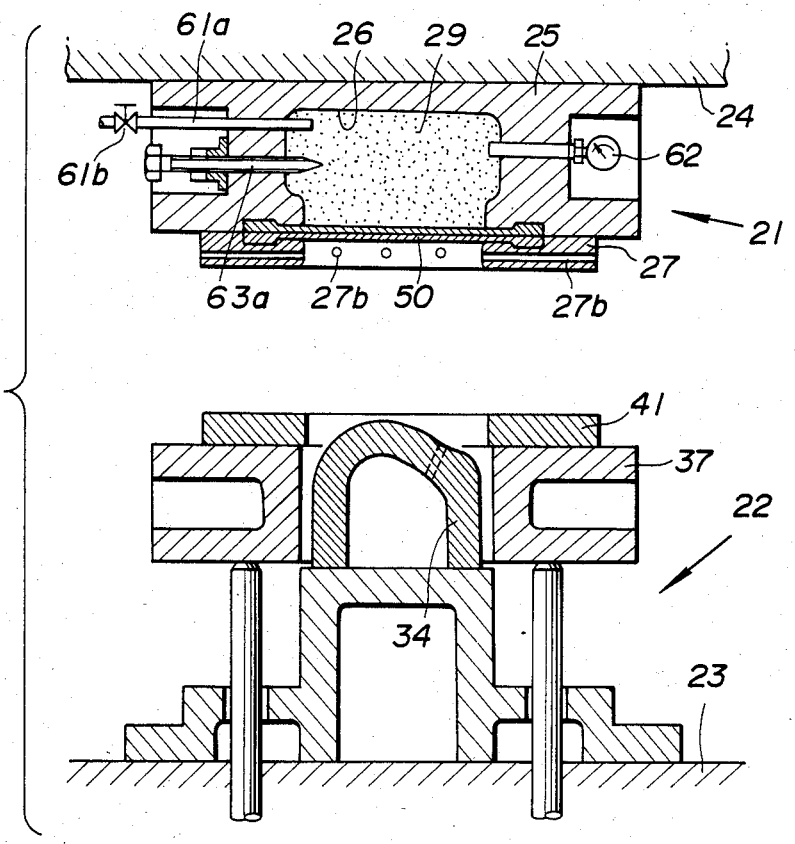
FIG. 11 is a sectional side elevational view of the punch and die press shown in FIG. 7, the punch and die press being positioned at the time of starting a process for adjusting a final pressing pressure in the method of the third embodiment.
Figure 12:
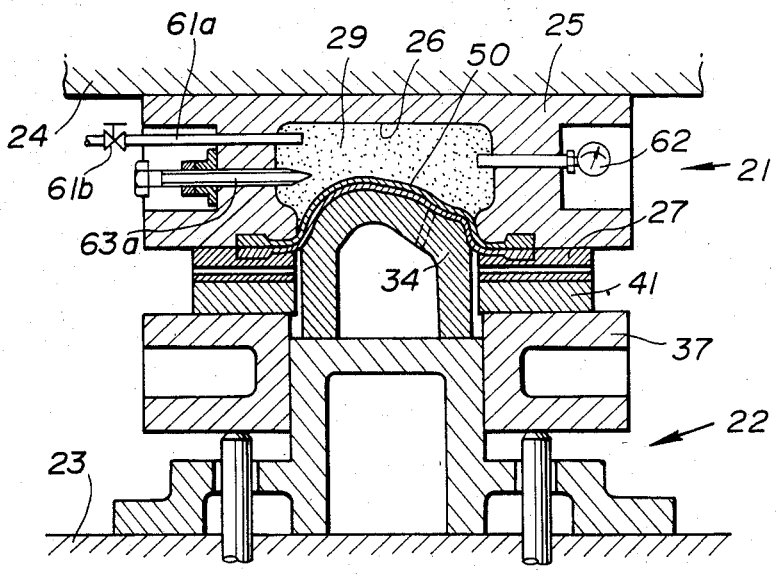
FIG. 12 is a sectional side elevational view of the punch and die press shown in FIG. 7, the punch and die press being positioned at the time of completing the process for adjusting a final pressing pressure in the method of the third embodiment.

As shown in FIG. 11, the die assembly 21 with the highly viscous substance 29 filling the cavity 26 is placed on the ram 24. Then, the ram 24 is lowered to allow the punch 34 to enter the cavity 26 in the die assembly 21 until finally the ram 24 is lowered to a lower limit corresponding to the depth of a drawn product, as shown in FIG. 12.

As the punch 34 enters the cavity 26, raising the pressure sheet 50, the volume of the cavity 26 is reduced and the pressure therein is increased. When the ram 24 is lowered to its lower limit, the final pressing position is reached.

According to the pressing method of the third embodiment, while the punch 34 enters the cavity 26 from the starting position to the most advanced position (when the ram 24 is at the lower limit), the valve 61*b* of the discharge device 61 is appropriately opened and closed to discharge a portion of the highly viscous substance 29 out of the cavity for thereby adjusting the final pressing pressure in the cavity 26 close to a desired level. Thereafter, the rod 63*a* of the pressure adjusting device 63 is brought into or out of the cavity 26 to bring the cavity pressure to the desired pressure level. The desired final pressing pressure is determined by the shape and dimensions of the blank W, and is 200 $kg/cm^2$ in the method of the third embodiment.

Figure 13:
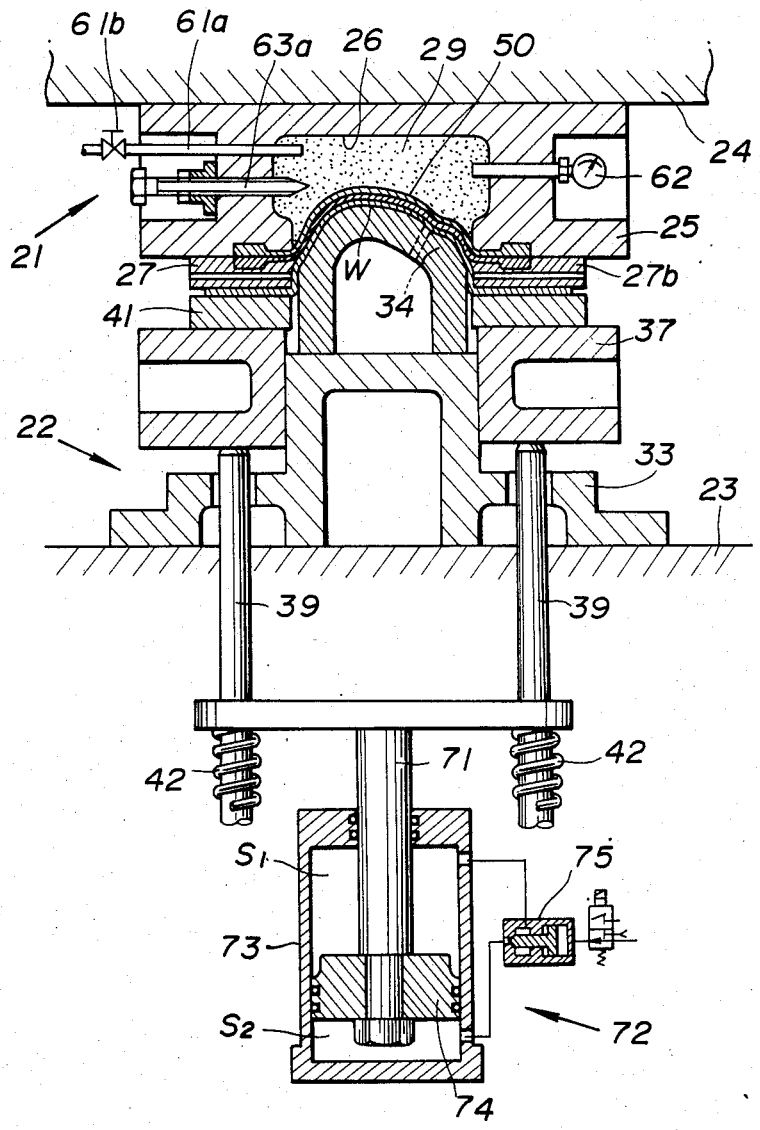
FIG. 13 is sectional side elevational view of the punch and die press shown in FIG. 7, the punch and die press being positioned at the time of completing a pressing process.

After the final pressing pressure has been established, the blank W such as a metal sheet is pressed in a process as described with respect to FIGS. 7 and 13.

The ram 24 is first raised as shown in FIG. 7 to position the die assembly 21 above the punch 34, and the blank W is placed on the holder plate 41 of the blank holder mechanism 35.

Then, the ram 24 is lowered to clamp the peripheral edge of the blank W between the lower surface of the die 27 and the upper surface of the holder plate 41. At this time, the on-off valve 75 of the cylinder unit 72 is open so that the blank holder rods 39 supporting the blank holder base 37 are not under the control of the cylinder unit 72. Further depression of the ram 24 causes the blank holder base 37 to be lowered against the resilient force of the springs 42 biasing the blank holder rods 39. During this downward movement, the blank W is also lowered while it is gripped between the die 27 and the holder plate 41, and the upper end portion of the punch 34 enters the cavity 26 while drawing the blank W and lifting the pressure sheet 50. The highly viscous substance 29 changes its shape in complementary relation to the configuration of the upper end portion of the punch 34, and the blank W is pressed between the punch 34 and the pressure sheet 50 into a shape complementary to the configuration of the punch 34 under the back pressure of the highly viscous substance 29 (FIG. 13). At this time, the pressing pressure in the cavity 26 is equal to the predetermined final pressing pressure.

Since the punch 34 is fixed and the die 27 is moved in the above embodiment, the entrance of the punch 34 into the cavity 26 is equivalent to relative movement of the punch 34 with respect to the die 27. Although either the punch 34 or the die 27 may be moved, the die assembly 21 has been described as the moving part to facilitate understanding.

Figure 14:
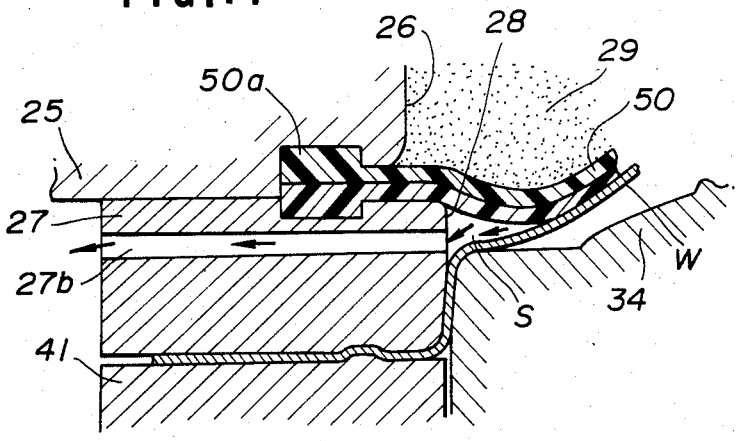
FIG. 14 is an enlarged fragmentary cross-sectional view of the die assembly and a punch in the punch and die press illustrated in FIG. 7, the punch and die pressing being shown as operating in the pressing process.

When the blank W is clamped between the die 27 and the holder plate 41 as the punch 34 starts entering the cavity 26, a closed space S is created between the lower surface of the pressure sheet 50, an inner pheripheral surface of the opening 28 in the die 27, and the upper surface of the blank W as shown in FIG. 14. The space S has its volume reduced upon progressive entrance of the punch 34 into the cavity 26. An amount of air corresponding to a reduction in the volume of the space S is discharged out through the air bleeder holes **27*b* in the die 27**, so that , the space S will not have its air pressure increased, and the peripheral edge of the product can be formed highly accurately.

Upon downward movement of the blank holder rods 39, the piston 74 in the cylinder unit 72 for driving the blank holder ram 71 is also lowered to cause working oil in the lower chamber $S_2$ in the cylinder 73 to flow through the on-off valve 75 into the upper chamber $S_1$. When the die assembly 21 reaches its lower limit of downward movement, the on-off valve 75 is closed to lock the blank holder base 37 with respect to the bolster plate 23.

Figure 15:
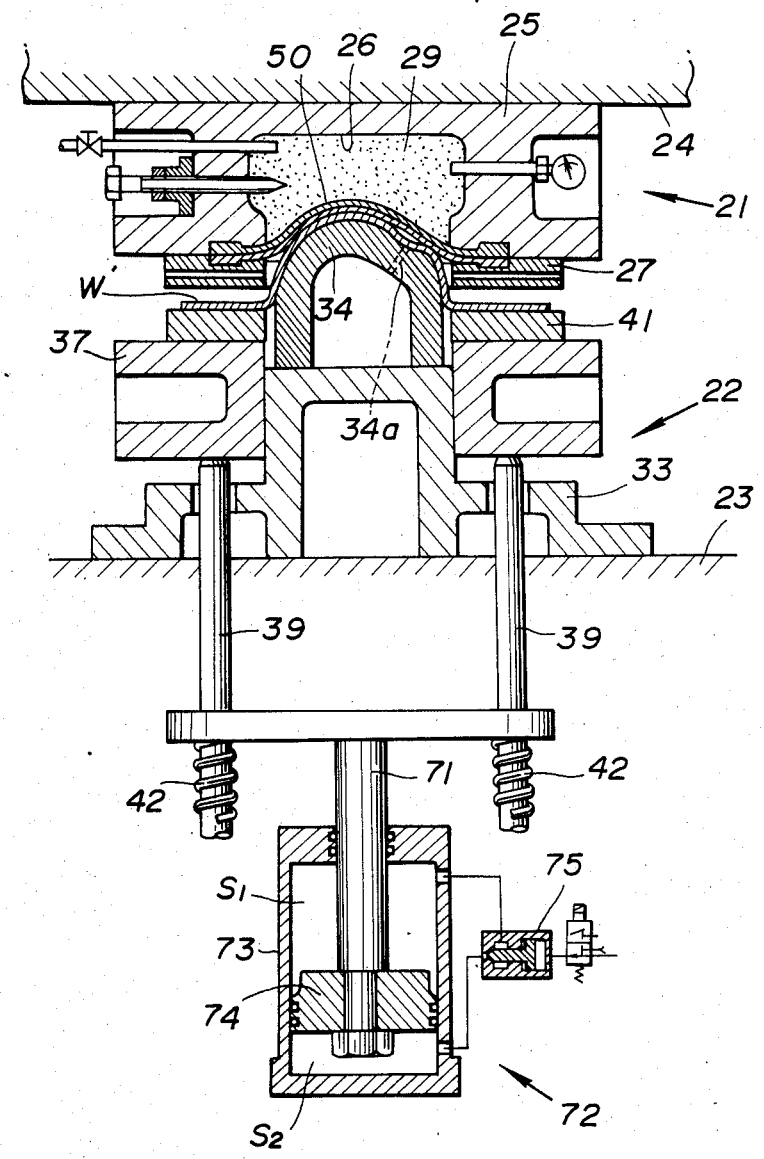
FIG. 15 is a sectional side elevational view of the punch and die press shown in FIG. 7, showing the punch and die press in a position immediately after a product releasing process has started.
Figure 16:
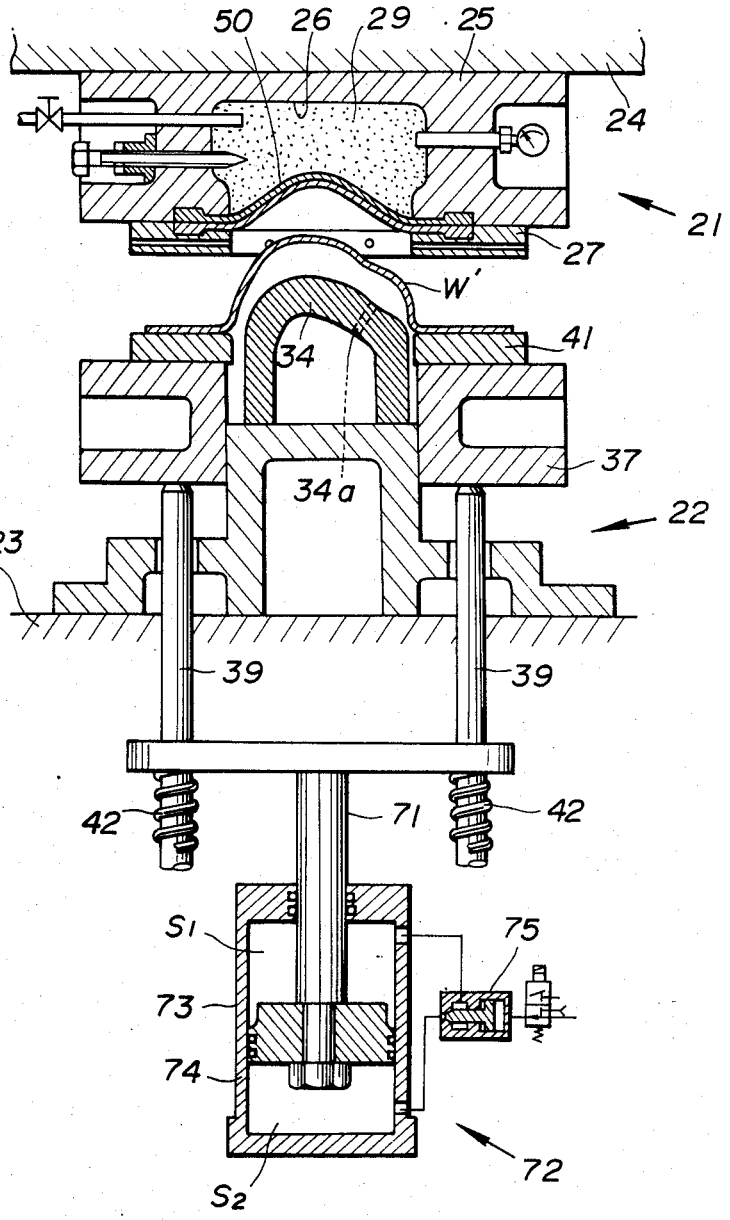
FIG. 16 is a sectional side elevational view of the punch and die press of FIG. 7, showing the punch and die press in a position immediately before the product releasing process is completed.

Thereafter, the pressed product, designated at W′, is removed in a process as shown in FIGS. 15 and 16.

As shown in FIG. 15, the ram 24 is raised while the on-off valve 75 in the cylinder unit 72 is closed. With the on-off valve 75 closed, the blank holder base 37 remains locked, and only the die assembly 21 is lifted, leaving the product W′ unraised with its lower surface kept in intimate contact with the surface of the punch 34.

When the die assembly 21 is moved upwardly to a certain height with the upward movement of the ram 24 as shown in FIG. 16, the on-off valve 75 is opened. The blank holder base 37 is now unlocked and moved upwardly under the resiliency of the springs 42 to raise the product W′ off the punch 34. The through passage **34*a* in the punch 34 near its upper end serves to allow air to flow into a space between the punch 34 and the product W′, assisting the latter in parting from the punch 34**.

Although in the third embodiment the die assembly 21 is mounted on the ram 24 and the punch assembly 22 is mounted on the bolster plate 23, the punch assembly 22 may alternatively be mounted on the ram 24 and the die assembly 21 may be mounted on the bolster plate 23. With such an alternative arrangement, the product W′ is raised with the punch 34 in intimate contact therewith for being separated from the die assembly 21. The requirement to be met in separating the product W′ is that the product W′ should be free from any influence due to the restoration of the highly viscous substance 29 to its original shape due to its flowability.

Figure 17:
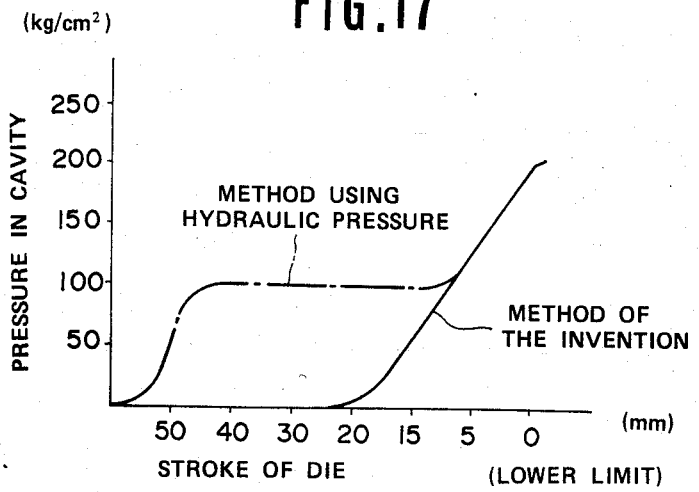
FIG. 17 is a graph showing variations of the pressure in a cavity during the pressing process in the method according to the third embodiment, the graph being also illustrative of such pressure variations in a conventional liquid-pressure pressing method for comparison.

FIG. 17 is a graph illustrating, for comparison, variations in the pressure in the cavity according to a pressing method of the present invention and a conventional liquid-pressure pressing method. With the prior liquid-pressure pressing method, the liquid pressure approaches the final pressing pressure well before the punch reaches the end of its lower stroke, and hence products cannot be formed highly accurately in a deep drawing process. According to the pressing method of the invention, however, the pressure reaches the final pressing pressure in the vinicity of the end of the lower stroke of the punch, with the consequence that a blank being pressed is subjected to the uniform back pressure of the highly viscous substance, and the product can be formed with high accuracy by deep drawing.

A pressing method according to a fourth embodiment of the present invention will now be described. This method is effected by employing the punch and die press shown in FIG. 7, and differs mainly from the method of the third embodiment as to the process of adjusting the final pressing pressure of the highly viscous substance in the cavity in the die assembly.

Figure 19:
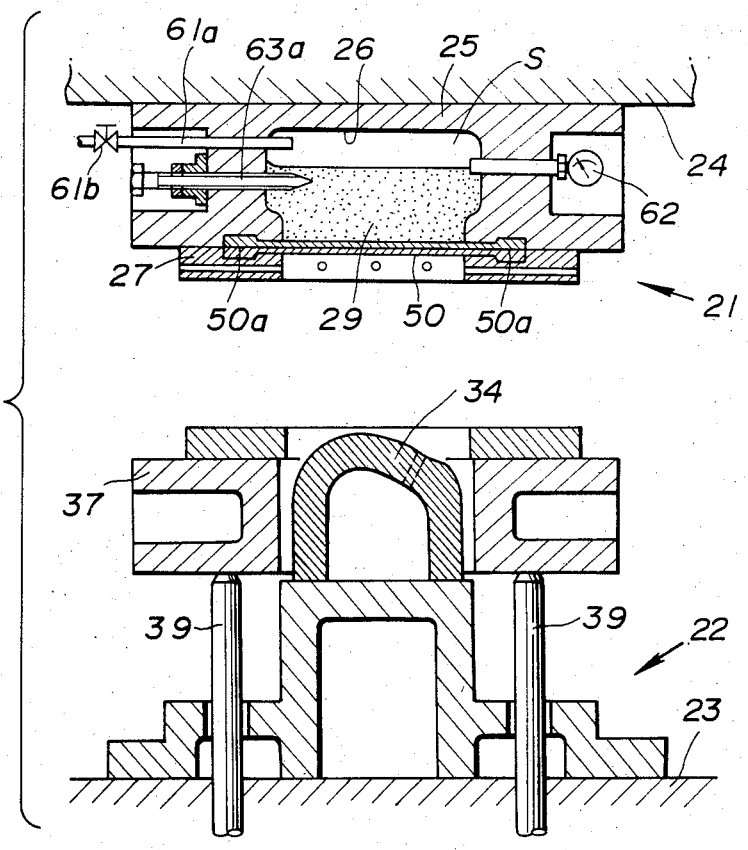
FIG. 19 is a sectional side elevational view of the punch and die press of FIG. 7, the punch and die press being in a position at the time of starting the process for adjusting a final pressing pressure in the method of the fourth embodiment.

According to the adjusting process in the method of the fourth embodiment, a certain quantity of a dilatant, highly viscous substance 29, which is a certain percentage of the volume of the cavity 26, is placed in the cavity 26, with an empty space S left over the surface of the highly viscous substance 29. Then, the die assembly 21 is attached to the ram 24 with the pressure sheet 50 facing downwardly, as illustrated in FIG. 19. At this time, the highly viscous substance 29 is displaced downwardly by gravity while the space S is formed thereabove. Then, the ram 24 is lowered to cause the punch 34 to enter the cavity 26 in the die assembly 21 until finally the ram 24 is moved downwardly to its lower limit dependent on the depth of a drawn product as shown in FIG. 12.

Since the punch 34 enters the cavity 26, the volume of the cavity 26 is reduced and the pressure therein is increased. The final pressing position is reached when the ram 24 is lowered to the lower end of its stroke. Now, air in the space S is completely removed from the cavity 26, and there is no empty space left in the cavity 26.

With the method of the fourth embodiment, the valve **61*b* in the discharge pipe 61*a* is suitably opened and closed after the punch 34 starts entering the cavity 26** and until the punch 34 reaches the most advanced position (when the ram 24 reaches the lower end of its stroke), for thereby discharging air out of the cavity 26 to adjust the cavity pressure close to the final pressure. Then, the rod 63*a* of the pressure adjusting device is pushed into or retracted out of the cavity 26 to reach the desired final pressing pressure.

After the final pressing pressure has been established in the foregoing manner, a blank such as a metal sheet is pressed. Such a pressing process and a subsequent process are the same as those described in the third embodiment, and will not be repeated here.

The methods of the third and fourth embodiments will now be evaluated by way of comparison. If the amount of the highly viscous substance left in the cavity in the die assembly after the final pressing pressure has been adjusted can be predicted relatively accurately, then the method of the fourth embodiment is preferred since the highly viscous substance is subjected to a smaller loss. If the amount of the highly viscous substance left in the cavity in the die assembly cannot be predicted relatively accurately, then the method of the third embodiment is preferred since the possibility of a pressure adjustment failure is smaller. Although air in the space S is completely discharged from the cavity in the fourth embodiment, a small space may be left in the cavity in this embodiment.

Figure 20:
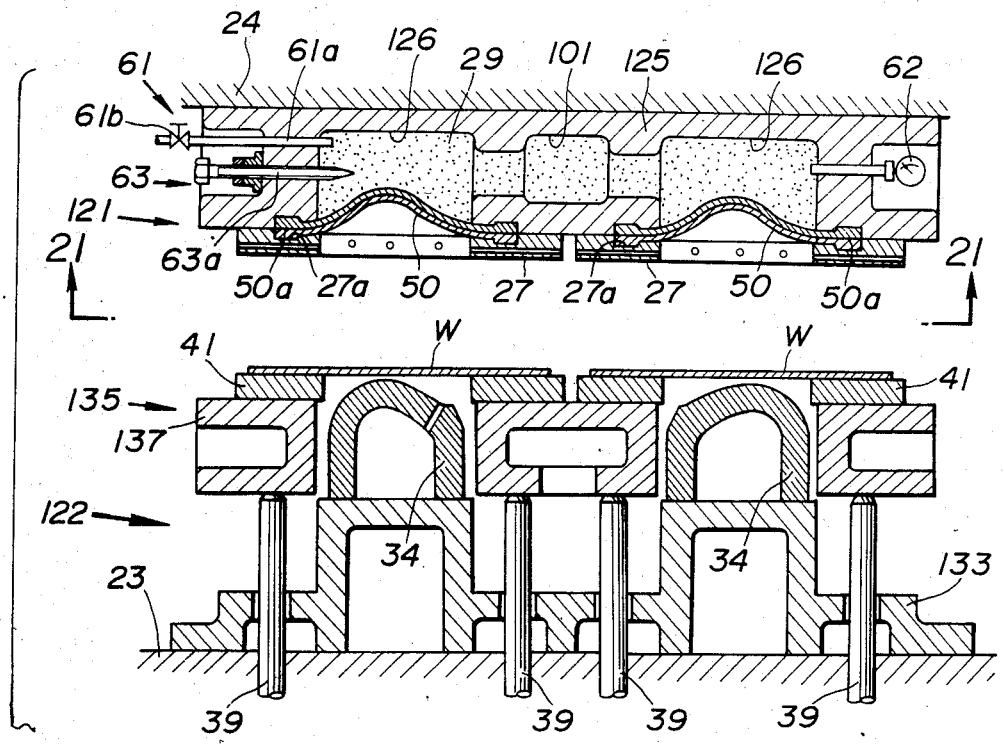
FIG. 20 is a sectional side elevational view of a punch and die press employed for carrying out a pressing method according to a fifth embodiment of the present invention, the punch and die press being positioned prior to the starting of a pressing process.
Figure 18:
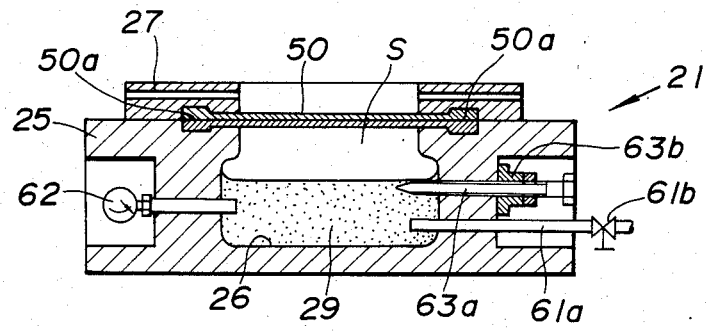
FIG. 18 is a sectional side elevational view of the die assembly in the punch and die press shown in FIG. 7, the die assembly being shown as being filled with a highly viscous substance in preparation for a process for adjusting a final pressing pressure in a pressing method according to a fourth embodiment.
Figure 21:
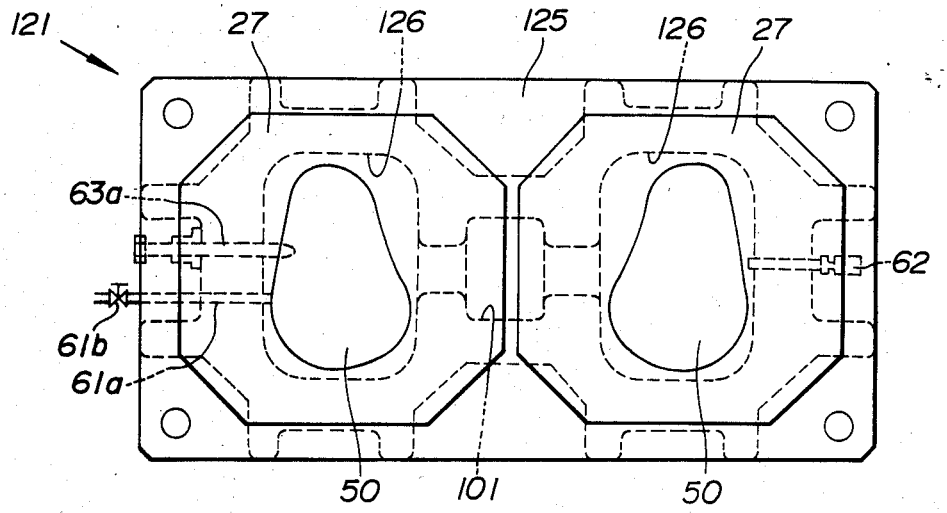
FIG. 21 is a bottom view taken along line 21—21 of FIG. 20, showing the bottom of a die assembly in the punch and die press shown in FIG. 20.
Figure 22:
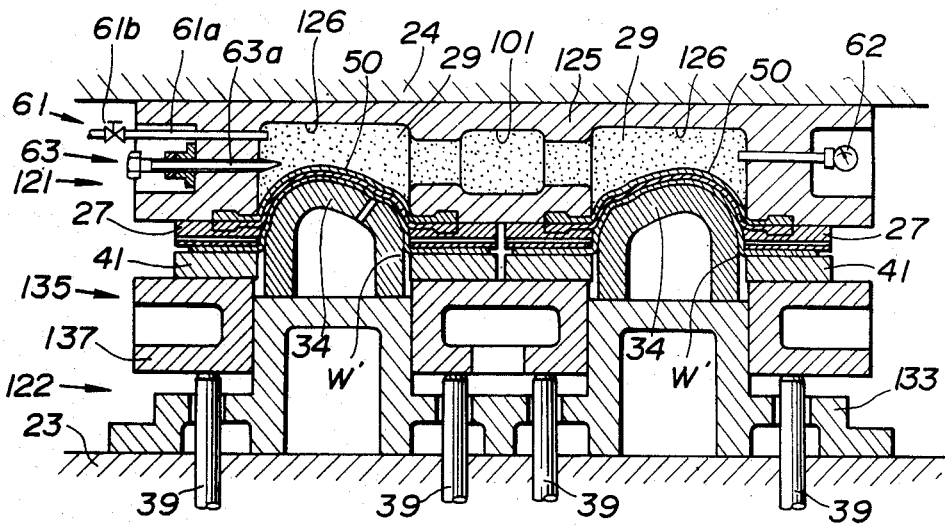
FIG. 22 is a sectional side elevational view of the punch and die press shown in FIG. 20, the punch and die press being in a position at the time the pressing process is over.

FIGS. 20 through 22 illustrate a punch and die press employed for carrying out a pressing method according to a fifth embodiment of the present invention. The method of the fifth embodiment has an advantage in that a plurality of products can be manufactured under the same pressing condition in a one-stroke pressing operation.

The punch and die press shown in FIG. 20 is placed in a known press machine and is comprises a die assembly 121 and a punch assembly 122.

The die assembly 121 has a die holder 125 including two cavities 126 communicating with each other by a passage 101 for accommodating a highly viscous substance, two dies 27 disposed respectively around the openings of the cavities 126, and two pressure sheets 50 covering the cavities 126, respectively. Each of the halves of the die assembly 121 is of the same construction as that of the die assembly shown in FIG. 7. Since the cavities 126 are in mutual communication, a discharge device 61 for discharging the highly viscous substance 29 from the cavities, a pressure gage 62 for indicating the pressure of the highly viscous substance in the cavities, and an adjusting device 63 for adjusting the pressure of the highly viscous substance are associated with only one of the two cavities 126. The discharge device 61, the pressure gage 62, and the adjusting device 63 are of the same construction as those shown in FIG. 7.

The punch assembly 122 comprises of a punch holder 133, two punches 34 fixed to the punch holder 133, and a blank holder mechanism 135 disposed around the punches 34. Each of the halves of the punch assembly 122 is of the same construction as that of the punch assembly illustrated in FIG. 7. A mechanism for operating the blank holder mechanism 135 is also of the same construction as that of the mechanism shown in FIG. 7, and is omitted from illustration in FIGS. 20 and 22.

The pressing method according to the fifth embodiment, employing the punch and die press described above, will be described hereinbelow.

In this pressing method, the final pressing pressure is adjusted prior to the time that a pressing operation is effected as with the method of the third embodiment. The cavity 126 is completely filled with the highly viscous substance 29 leaving no empty space in the cavity 126. The highly viscous substance 29 has a so-called dilatancy property such that its flowability is lost when subjected to an abrupt external force and is restored if the applied external force is reduced. The highly viscous substance may be silicone or a non-curing vinyl chloride sealant, for example. With no blanks W placed on holder plates 41 of the blank holder mechanism, the ram 24 is moved downwardly to a prescribed lower limit. During such downward movement, the punches 34 enter the cavities 126, respectively, to increase the pressure in the cavities 126. The valves 61*b* in the discharge pipes 61*a* are opened and closed to discharge a portion of the highly viscous substance 29 out of the cavities 126, and at the same time the rod 63*a* for fine adjustment of the pressure is taken into or out of the cavity 126 to establish final pressing pressures in the cavities 126. Since the cavities 126 are in mutual communication through the passage 101, the pressures in the cavities are equal to each other.

Thereafter, the ram 24 is lifted and blanks W are placed in position as shown in FIG. 20. Then, the ram 24 is lowered again. The blanks W are clamped at their peripheral edges between the lower surfaces of the dies 27 and the upper surfaces of the holder plates 41. Since a blank holder base 137 is supported on the upper ends of the blank holder rods 39 urged upwardly by springs (not shown), the blanks W as clamped between the dies 27 and the holder plates 41 are lowered against the resiliency of the springs upon downward movement of the ram 24. The upper end portions of the punches 34 draw the blanks W while raising the pressure sheets 50, and enter the cavities 126. As a result, the highly viscous substance 29 changes its shape in complementary relation to the configurations of the upper end portions of the punches 34. Finally, the blanks W are pressed between the punches 34 and the pressure sheets 50 under the back pressure of the highly viscous substance 29. As the cavities 126 are held in communication with each other through the passage 101, the pressures in the cavities 126 are equal to each other, and hence the blanks W are pressed under the same pressure.

Subsequently, the ram 24 is raised while leaving pressed products W′ on the punches 34. When the die assembly 121 is fully separated from the products W′, a cylinder unit (not shown) is actuated to enable the springs biasing the rods 39 upwardly to lift the blank holder base 137 for thereby separating the products W′ from the punches 34. The products W′ are now ejected from the press.

As an alternative to the illustrated arrangement, the die assembly 121 may be mounted on the bolster plate 23, and the punch assembly 122 may be mounted on the ram 24. While the highly viscous substance 29 is shown as being completely filled in the cavities 126, a space may be left in the cavities 126 when the highly viscous substance 29 is placed therein. With such a space created, the final pressing pressure is established by extracting a portion of air from the space. More than two cavities 126 may be provided in the die holder 125.

With the method of the fifth embodiment, two or more cavities filled with the highly viscous substance are provided in the die assembly and held in mutual communication through the passage. Therefore, the final pressing pressure can be established in all of the cavities simply by adjusting the pressure in one of the cavities. A plurality of blanks can accordingly be pressed simultaneously under the same pressing condition, so that pressed products of the same configuration can be manufactured highly efficiently.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

What is claimed is:

1. A method of pressing a blank, comprising the steps of:

(a) pressing the blank between a die assembly having a cavity containing a highly viscous substance with dilatant and thixotropic properties therein, and a punch;

(b) inserting said punch into said cavity to increase a pressure of the highly viscous substance in said cavity; and (c) pressing said blank against a surface of said punch under said pressure of said highly viscous substance such that the pressure of said highly viscous substance does not reach a final pressing pressure until said punch closely approaches a final insertion depth on said cavity.

2. A method according to claim 1, wherein said highly viscous substance in said cavity is covered at a surface thereof with a flexible pressure sheet, said pressure of said highly viscous substance on said blank being applied through said pressure sheet to said blank.

3. A method according to claim 2, wherein said pressure sheet comprises a pair of superimposed sheet members.

4. A method according to claim 2, wherein said die assembly includes a discharge device, said cavity further contains a quantity of air directly in contact with said highly viscous substance, and said air is discharged through said discharge device during said step of increasing the pressure of said highly viscous substance.

5. A method according to claim 2, wherein said die assembly includes a discharge device through which an amount of said highly viscous substance is discharged during said pressure increasing step, and an adjusting device which is moved into and out of said cavity subsequent to said pressure increasing step for fine adjustment of the pressure in said cavity.

6. A method according to claim 1, wherein said die assembly has a plurality of cavities communicating with each other through a passage.

7. A method according to claim 1, wherein said highly viscous substance is silicone.

8. A method according to claim 1, wherein said highly viscous substance is a non-curing vinyl chloride sealant.

9. A punch and die press comprising:

(a) a punch having a shape complementary to a product to be manufactured;

(b) a die assembly having a cavity with an opening thereof allowing said punch to enter said cavity; and (c) a highly viscous substance having dilatant and thixotropic properties contained in said cavity of said die assembly.

10. A punch and die press according to claim 9, wherein said die assembly further includes a flexible pressure sheet covering a surface of said highly viscous substance.

11. A punch and die press according to claim 10, including a discharge device mounted on said die assembly for discharging said highly viscous substance out of said cavity, an adjusting device mounted on said die assembly and movable into and out of said cavity for fine adjustment of the pressure in said cavity, and a pressure gage mounted on said die assembly for measuring the pressure in said cavity.

12. A punch and die press according to claim 9, wherein said die assembly has a plurality of cavities communicating with each other through a passage.

13. A punch and die press according to claim 9, wherein:

said highly viscous substance is silicone.

14. A punch and die press according to claim 9, wherein:

said highly viscous substance is a non-curing vinyl chloride sealant.

* * * * *

UNITED STATES PATENT AND TRADEMARK OFFICE

CERTIFICATE OF CORRECTION

PATENT NO. : 4,689,979
DATED : September. 1, 1987
INVENTOR(S) : Nobuyuki OTSUKA et al.

It is certified that error appears in the above-identified patent and that said Letters Patent is hereby corrected as shown below:

Column 1, line 42, change "damages" to --damage--.
Column 2, line 2, after "FIG. 1," delete "the view".
Column 3, line 42, after "valve" insert --32--.
Column 4, line 8, change "s" to --S--;
line 17, correct the spelling of -flattened--.
Column 6, line 4, change "23" to --33--;
line 5, change "33" to --23--;
line 31, change "64" to --74--.
Column 7, line 41, correct the spelling of --peripheral--.
Column 9, line 37, after "and" delete "is";
line 57, after "comprises" delete "of".
Claim 1, line 15, (column 11, line 31) change "on" to --in--.
ABSTRACT, lines 8-9, change "product" to --products--.
line 9, after "shape" insert --which are--.
line 10, change "damages" to --damage--.
line 12, change "above said" to --aforesaid--.

Signed and Sealed this

Twenty-ninth Day of March, 1988

*Attest:*

DONALD J. QUIGG

*Attesting Officer*

*Commissioner of Patents and Trademarks*